US006102563A

United States Patent [19]

Damasko

[11] Patent Number: 6,102,563

[45] Date of Patent: Aug. 15, 2000

[54] CASE FOR WRIST WATCHES

[76] Inventor: Konrad Damasko, Unterheising 2, D-93092 Barbing, Germany

[21] Appl. No.: 09/297,396

[22] PCT Filed: Oct. 30, 1996

[86] PCT No.: PCT/DE96/02062

§ 371 Date: Apr. 29, 1999

§ 102(e) Date: Apr. 29, 1999

[87] PCT Pub. No.: WO98/19220

PCT Pub. Date: May 7, 1998

[51] Int. Cl.[7] ..... G04B 37/00

[52] U.S. Cl. ..... 368/280

[58] Field of Search ..... 368/88, 276, 280

[56] References Cited

U.S. PATENT DOCUMENTS 4,433,921 2/1984 Gogniat et al. ..... 368/294

4,561,783 12/1985 Lederrby ..... 368/309

FOREIGN PATENT DOCUMENTS 2579997 10/1986 France .

4407179 9/1995 Germany .

*Primary Examiner*—Vit Miska

*Attorney, Agent, or Firm*—Bierman, Muserlian and Lucas

[57] ABSTRACT

A wrist watch which encloses clockworks is made of a hardenable, nickel-free stainless steel with a carbon content greater than 0.4% and a chromium content greater than 12%, molybdenum greater than 0.2% and vanadium greater than 0.2%.

14 Claims, 1 Drawing Sheet

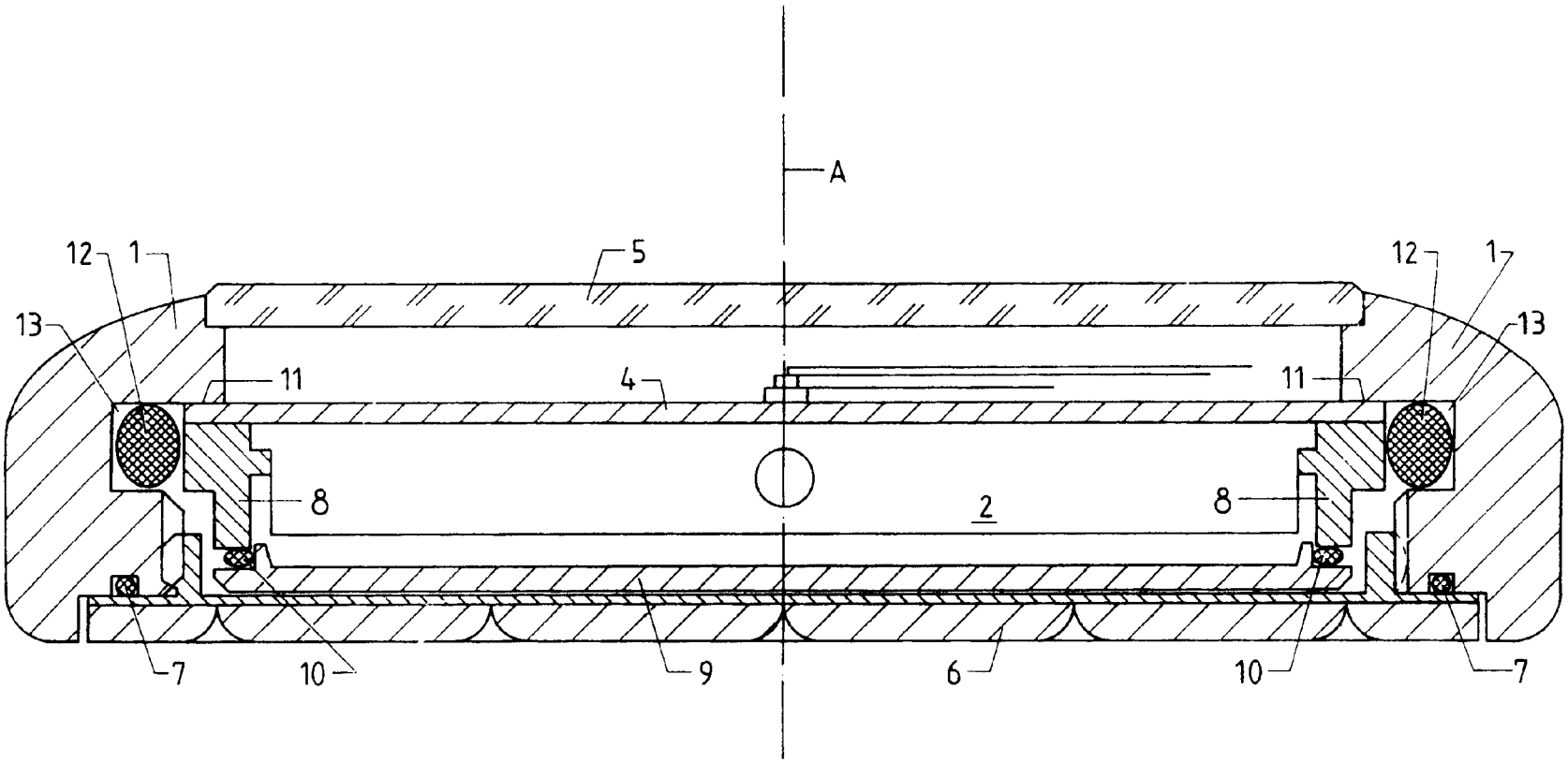
13
1
12
11
8
2
A
5
4
11
8
1
12
13
7
10
6
9
10
7

CASE FOR WRIST WATCHES

The invention pertains to a case for wrist watches having a case which houses the clockworks therein and which is closed on the top by a glass piece and on the bottom by a cover.

BACKGROUND

Cases for wrist watches are known in a wide variety of embodiments.

It is also known that highly tempered corrosion-resistant objects such as knives, scissors, surgical instruments, tools etc. can be manufactured inexpensively on conventional machines and by hardening afterwards using steel with the following composition:

| | |
|---|---|
| carbon: | 0.6–2% |
| chromium: | 16–25% |
| tungsten: | 1–7% |
| molybdenum | 0.2–2% |
| vanadium: | 0.2–3% |
| traces of iron. | |

The object of the invention is to provide for a case that possesses a high degree of functionality and stability.

SUMMARY OF THE INVENTION

In order to solve this problem, a case for a wrist watch which encloses a clockworks is made of a hardenable, nickel-free stainless steel with a carbon content greater than 0.4% and a chromium content greater than 12%, molybdenum greater than 0.2% and vanadium greater than 0.2%, manufactured by machining from a solid material and hardened afterwards, and that a ring which encloses the clockwork in the case is made of a diamagnetic metal material.

According to the present invention, at least the case element, but preferably also the outer cover that closes the case on the bottom is made of a hardenable, nickel-free stainless steel that has a carbon content greater than 0.4% and, in alloy, a chromium content greater than 12%, a molybdenum content greater than 0.2% and a vanadium content greater than 0.2%.

The temperable or hardenable steel preferably belongs to the group X110 CrMoV 15 or X105 CrMo 17.

In addition, a case-hardenable steel is suitable for the manufacture of the outer part of the case and/or the cover that has a carbon content greater than 0.1%, preferably between 0.1 and 6%, a chromium content greater than 12%, a tungsten content greater than 1.0%, a molybdenum content greater than 0.2%, a vanadium content greater than 0.2% and a silicon content greater than 0.2%.

Although the aforementioned steels can be processed in an unhardened state by conventional means and on conventional machines in a relatively simple and inexpensive manner, and after tempering a very robust, hard watch case is obtained, these materials have heretofore been regarded by experts as fully unsuitable for the manufacture of clock cases and especially for wrist watches, due to the fact that the aforementioned hardenable steels are without exception highly magnetizable, especially by external magnetic fields, so that they function as permanent magnets that strongly impair the very sensitive clockwork of a wrist watch. Other technologies are thus used to obtain highly hardened watch cases; these cases are manufactured from ceramics, which is, however, an expensive and complicated process.

The invention is based on the realization that the aforementioned hardenable steels surprisingly are suitable, in spite of their being magnetizable, also for wrist watch cases, if in the interior of the case the ring surrounding the clockwork also is made of the diamagnetic metal. It has been shown that by means of this ring the part of the case interior that houses the clockwork can be kept free from a magnetic field that would impair the functioning and accuracy of the clockwork.

Further embodiments of the invention are the subject of the dependant claims.

BRIEF DESCRIPTION OF THE DRAWING

In the following, the invention is described in more detail by way of an example embodiment with reference to the figure. The figure shows a cross-section in simplified depiction of a case according to the invention for a men's and/or ladies' wrist watch, together with a clockwork located in this case.

DETAILED DESCRIPTION

In the figure, 1 is the outer case of a men's and ladies' wrist watch, in which the clockwork 2 with the hands 3 and the face 4 is housed and which is closed tightly on the top, shown at the top of the figure, by a glass or crystal 5 of sapphire glass and on the bottom by a cover 6. The axis of the clockwork 2, around which the hands 3 revolve, is designated by A. The crystal 5 is embedded in a suitable manner in a groove on the top of the case and fastened there tightly, for example by gluing or some other suitable means. The cover 6 is fastened to the bottom of the case 1 by screwing, and sealed by a sealing or O-ring 7.

In the interior of the case 1, a ring 8 is provided for that encircles the clockwork 2 and which houses the clockwork 2. The ring 8 has an axial height that is equal or similar to the height of the clockwork 2. Additionally, in the interior of the case 1 an intermediate cover 9 is provided for that closes the ring 8 on the side facing the outer cover 6 and, by means of a second sealing ring 10, tightly seals the auxiliary case formed by the ring 8 below, i.e. on the side facing the cover 6. The surfaces of the intermediate cover 9 are located parallel to the surfaces of the outer cover 6 and parallel to the surfaces of the face 4 and the glas or crystal 5 and thus also in planes perpendicular to the axis A of the watch, that is determined by the axis of the hands 3. The intermediate cover 9 is held on the ring 8 by the fact that this intermediate cover is pressed on the side opposite of the clockwork 2 against the inner surface of the outer cover 6, under elastic deformation of the sealing ring 10, so that a positioning of the intermediate cover 9 without rattling or clattering is ensured.

The ring 8 is supported on the side depicted above in the figure on the circumference of the face 4, which itself is pressed against a flange 11 that is formed on the inner surface of the case 1 in such a way that the diameter of the interior of the case 1 becomes smaller toward the top of the case to form a circular bearing surface (flange 11) in a plane perpendicularto the axis A. 12 designates a ring made of an elastic material such as elastic plastic or rubber, that encompasses the ring 8 on the end adjacent to the face 4 as well as the axis A and is positioned in an open groove 13 of the case toward the interior of the case. The damper ring 12 forms an elastic bedding of the ring 8 and thus of the clockwork 2 and protects this clockwork from external shocks affecting the watch.

The characteristic feature of the depicted watch consists in the fact that the case 1 as well as the outer cover 6 are manufactured from a solid material by machining on a metal lathe, preferably on a CNC lathe, from a corrosion-resistant and acid-proof, yet nickel-free steel that is hardenable and has a carbon content greater than 0.1%. In addition to the carbon, this steel contains an alloy of chromium, molybdenum and vanadium.

For the manufacture of the case 1 and the outer cover 6 a steel especially of the group X55 CrMo 14, X65 CrMo 14, X90 CrMoV 18, X105 CrMo 17 and X 110 CrMoV 15, preferably the steels X105 CrMo 17 and X110 CrMoV 15, is used, whereby these latter steels contain carbon, silicon, manganese, phosphorus, sulfur, molybdenum and vanadium in the following amounts:

| X110CrMoV 15: | |
|---|---|
| carbon (C): | 1.05–1.15% |
| silicon (Si): | 1.0% |
| manganese (Mn): | 1.0% |
| phosphorus (P): | 0.045% |
| sulfur (S): | 0.03% |
| chromium (Cr): | 14.00–16.00% |
| molybdenum (Mo): | 0.4–0.6% |
| vanadium (V): | 0.1–0.15% |

| X105 CrMo 17: | |
|---|---|
| carbon (C): | 0.95–1.2% |
| silicon (Si): | 1.0% |
| manganese (Mn): | 1.0% |
| phosphorus (P): | 0.045% |
| sulfur (S): | 0.3% |
| chromium (Cr): | 16.00–18.00% |
| molybdenum (Mo): | 0.4–0.8% |

In particular, the manufacture of the case 1 as well as the cover 6 from the solid material takes place by means of machining, in which a blank is first produced. Afterwards this blank is heated in a vacuum furnace or in a protective furnace atmosphere to a temperature above 1000° C., preferably to a temperature between 1030 and 1060° C. and then quenched. Following this, stress relief of the hardened blank takes place at a temperature below 200° C., i.e. at a temperature between approx. 170–180° C. for a period of one to two hours. The case 1 and the cover 6, which then have a hardness of up to 63 or 65 HRC, can be post-processed on the surfaces, for example by abrasive blasting with glass beads, mirror-bright polishing, CVD-PVD coating.

Alternatively, a case-hardenable steel is suitable for the case 1 and/or the cover 6 which contains the following percentages of carbon, chromium, tungsten, molybdenum, vanadium, manganese and silicon:

| | |
|---|---|
| carbon (C): | 0.1–0.6% |
| silicon (Si): | >0.2% |
| manganese (Mn): | >0.2% |
| chromium (Cr): | >12% |
| molybdenum (Mo): | >0.2% |
| vanadium (V): | >0.2% |
| tungsten (W): | >1% |

The case 1 and the cover 6 can also be manufactured with a high degree of hardness using this case-hardenable steel, although the aforementioned steels X110 CrMoV 15 and X105 CrMo 17 are preferred.

With the process described above a high-quality and extremely durable case 1 with a cover 6 of the same high quality and durability can be achieved. In order to be able to use the aforementioned material, however, the intermediate ring 8 is necessary, which is made of one of the magnetic metal materials, i.e. of a material that deflects existing magnetic lines.

Suitable materials are especially copper alloys and specifically copper-tin or copper-zinc alloys. The ring 8 is preferably made of CuZn 40 A12. The face 4 or the disc forming this face and the intermediate cover 9 are made of the same material as the ring 8, so that the clockwork 2 is housed completely in a case or in a shield made of the magnetic metal material. Instead of the face 4 and/or the intermediate cover 9, it can suffice to have flat, disc-shaped rings that only partially close the upper and/or lower open sides of the ring 8.

Only with the embodiment described above is it possible to use the above-mentioned steel, which is easy-to-process and, after hardening, has an extremely high degree of hardness, for the case 1 and the outer cover 6, which are without exception magnetic and yet guarantee the high degree of accuracy for the sensitive clockwork 2.

| List of reference symbols | |
|---|---|
| 1 | case |
| 2 | clockwork |
| 3 | hands |
| 4 | face |
| 5 | crystal |
| 6 | outer case cover |
| 7 | sealing ring |
| 8 | intermediate ring |
| 9 | intermediate cover |
| 10 | sealing ring |
| 11 | flange |
| 12 | damper ring |
| 13 | groove |

What is claimed is:

1. Case for wrist watches, consisting of a case element (1) housing the clockwork with a glass (5) closing the case on the top and with a cover (6) closing the case on the bottom, characterized in that in the outer case element (1) an intermediate ring (8) that encircles the clockwork (2) is provided for, that at least the case element (1) is of a hardenable, nickel-free stainless steel with a carbon content greater than 0.4% and a chromium content greater than 12%, molybdenum content greater than 0.2% and vanadium content greater than 0.2%, manufactured by machining from a solid material and hardened afterwards, and that the ring enclosing the clockwork (2) is made of a diamagnetic metal material.

2. Case according to claim 1, characterized in that the hardenable stainless steel belongs to group X55 CrMo 14, X65 CrMo 14, X90 CrMoV 18, X105 CrMo 17 or X 110 CrMoV 15.

3. Cases for wrist watches, consisting of a case element (1) housing the clockwork with a glass (5) closing the case on the top and with a cover (6) closing the case on the bottom, characterized in that in the outer case element (1) an intermediate ring (8) that encircles the clockwork (2) is provided for, that at least the case element (1) is of a case-hardenable, nickel-free stainless steel, manufactured by machining from a solid material and hardened afterwards, and that the ring enclosing the clockwork (2) is made of a diamagnetic metal material, and the hardenable steel has the following alloy percentages:

| | |
|---|---|
| carbon: | 0.1–0.6% |
| chromium: | >12%–20% |
| tungsten: | >1%–3% |
| molybdenum: | >0.2%–2% |
| vanadium: | >0.2%–3% |
| manganese: | >0.2% |
| silicon: | >0.2% |

4. Case according to claim 1, characterized in that the outer cover (6) is likewise made of one of the hardenable stainless steels.

5. Case according to claim 1, characterized in that at least part of the face (4) is made of the diamagnetic metal material.

6. Case according to claim 1, characterized in that a cover (9) or ring made of the diamagnetic metal material is provided for on the side of the intermediate ring (8) facing the bottom of the case.

7. Case according to claim 1, characterized in that the diamagnetic metal material is a copper alloy.

8. Case according to claim 7, characterized in that the diamagnetic material is CuZn 40 A12.

9. Case according to claim 1, characterized in that the case element (1) and/or cover (6) are heated in a protective furnace atmosphere to a temperature above 1000° C.

10. Case according to claim 1, characterized in that the case element (1) and/or cover (6) after hardening and quenching are treated on the surface by abrasive blasting with glass beads.

11. Case according to claim 1, characterized in that the case element (1) and/or cover (6) after hardening and quenching are mirror-polished and/or PVD and/or CVD coated.

12. Case according to claim 2 characterized in that the hardened stainless steel belongs to X105 CrMo 17 or X110 CrMoV 15.

13. Case according to claim 7 characterized in that the copper alloy is a copper-tin or copper-zinc alloy.

14. Case according to claim 9 characterized in that the temperature is between 1030 and 1060° C.

* * * * *